United States Patent [19]

Silbernagel

[11] Patent Number: 4,729,205

[45] Date of Patent: Mar. 8, 1988

[54] METHOD OF PRODUCING FILM-WRAPPED PACKAGES OR PACKAGED UNITS, AND APPARATUS FOR CARRYING OUT SUCH METHOD

[76] Inventor: Peter Silbernagel, Weilautstrasse 18, D-4434 Ochtrup, Fed. Rep. of Germany

[21] Appl. No.: 1,523

[22] Filed: Jan. 8, 1987

Related U.S. Application Data

[62] Division of Ser. No. 690,242, Jan. 10, 1985, Pat. No. 4,655,028.

[30] Foreign Application Priority Data

Jan. 14, 1984 [DE] Fed. Rep. of Germany ..... 3401217
May 10, 1984 [DE] Fed. Rep. of Germany ..... 3417341

[51] Int. Cl.[4] ..... B65B 13/04; B65B 61/18

[52] U.S. Cl. ..... 53/133; 53/556; 53/588

[58] Field of Search ..... 53/399, 412, 133, 556, 53/588

[56] References Cited

U.S. PATENT DOCUMENTS

| | | | |
|---|---|---|---|
| 1,870,519 | 8/1932 | Leguillon | 53/133 X |
| 1,978,035 | 10/1934 | Thom | 53/133 |
| 2,653,432 | 9/1953 | Wright | 53/133 |
| 2,661,582 | 12/1953 | Hansen | 53/133 X |
| 3,593,483 | 7/1971 | Tracy | 53/412 |
| 3,807,118 | 4/1974 | Pike | 53/412 X |
| 4,203,270 | 5/1980 | Forman | 53/133 |
| 4,317,322 | 3/1982 | Lancaster | 53/556 X |

FOREIGN PATENT DOCUMENTS

| | | | |
|---|---|---|---|
| 2843931 | 4/1980 | Fed. Rep. of Germany | 53/412 |
| 2395898 | 3/1979 | France | 53/133 |

*Primary Examiner*—John Sipos
*Attorney, Agent, or Firm*—Cushman, Darby & Cushman

[57] ABSTRACT

A method of producing film-wrapped packages or packaged units, wherein a package or packaged unit is wrapped in a film hose formed by helical wrapping of the film (web) (30). In front of the wrapping front advancing relative to the package, a tear-up thread is also enclosed by the forming film hose. A wakening (tear-up) line is formed in the film hose in the vicinity and along the length of the tear-up thread. Here, an abutment for a spiked roller (10) is formed by a stationary tongue (12) above a conveyor belt (6) and below the film (web) (30).

6 Claims, 5 Drawing Figures

METHOD OF PRODUCING FILM-WRAPPED PACKAGES OR PACKAGED UNITS, AND APPARATUS FOR CARRYING OUT SUCH METHOD

This is a division of application Ser. No. 690,242, filed Jan. 10, 1985 now U.S. Pat. No. 4,655,028.

FIELD OF THE INVENTION

The present invention relates to a method for producing film-wrapped packaged or film-wrapped packaged units. More particularly, in the present method a package or packaged unit is conveyed through a wrapping device and while the package or packaged unit is passing through that wrapping device, the package or packaged unit is wrapped (enveloped) in a film hose formed by helically wrapping the film (web) about the package or packaged unit. Further, the present invention provides an apparatus for carrying out the above method.

The above term "packaged unit" is supposed to mean an mostly loose combination of individual packages or packets, such as, for example, 500 grams cardboard boxes, and the term "package" is meant to designate a single, possibly bulk wrapped material, e.g. a roll of carpet.

BACKGROUND OF THE INVENTION

A method of the above-indicated type is known from U.S. Pat. No. 4,317,322.

The packaging or wrapping of packages or packaged units by means of, for example, stretchable film has gained an increasing commercial importance in recent years. Owing to the elasticity (resilience) of the film, the individual packages or pockets combined in a packaged unit are held under a tension higher than that obtained with a package using thermally shrinking films.

However, the strength of the stretch film poses difficulties in subsequent processing. In this regard, the strength of the stretch film is such that the wrapping is difficult to remove from the packages. Indeed, the film wrapping must be severed from the packages by use of scissors or a knife. This is, however, extremely disadvantageous when goods are supplied to warehouses in small packages, which packages must be removed from the wrapped packaged units in a very short period of time for subsequent display and offer for sale. In such circumstances, each packaged unit must be opened and the goods removed from the thus opened package. This is cumbersome and time consuming. In addition, the same disadvantages result when packages, such as hooks (which can become damaged when the film is torn loose) are opened.

SUMMARY AND OBJECTS OF THE INVENTION

It is the object of the present invention to provide a method of producing film-wrapped packages or packaged units, in which the film wrapping may be manually opened easily and without any problem and without the need of using a knife or scissors.

According to the present invention, this object is solved in that in the method of producing film-wrapped packages or packaged units, in front of the wrapping front advancing relative to the package, at least one tear-up thread is passed to the package or packaged unit so as to be enclosed by the forming film hose, the thread is then, while adhering to the inner side of the film hose, drawn or unreeled from a supply thereof while the package or packaged unit is further advanced, and thereafter is severed upon passage of the package through the wrapping device.

A DETAILED DESCRIPTION OF THE INVENTION

Figure 1:
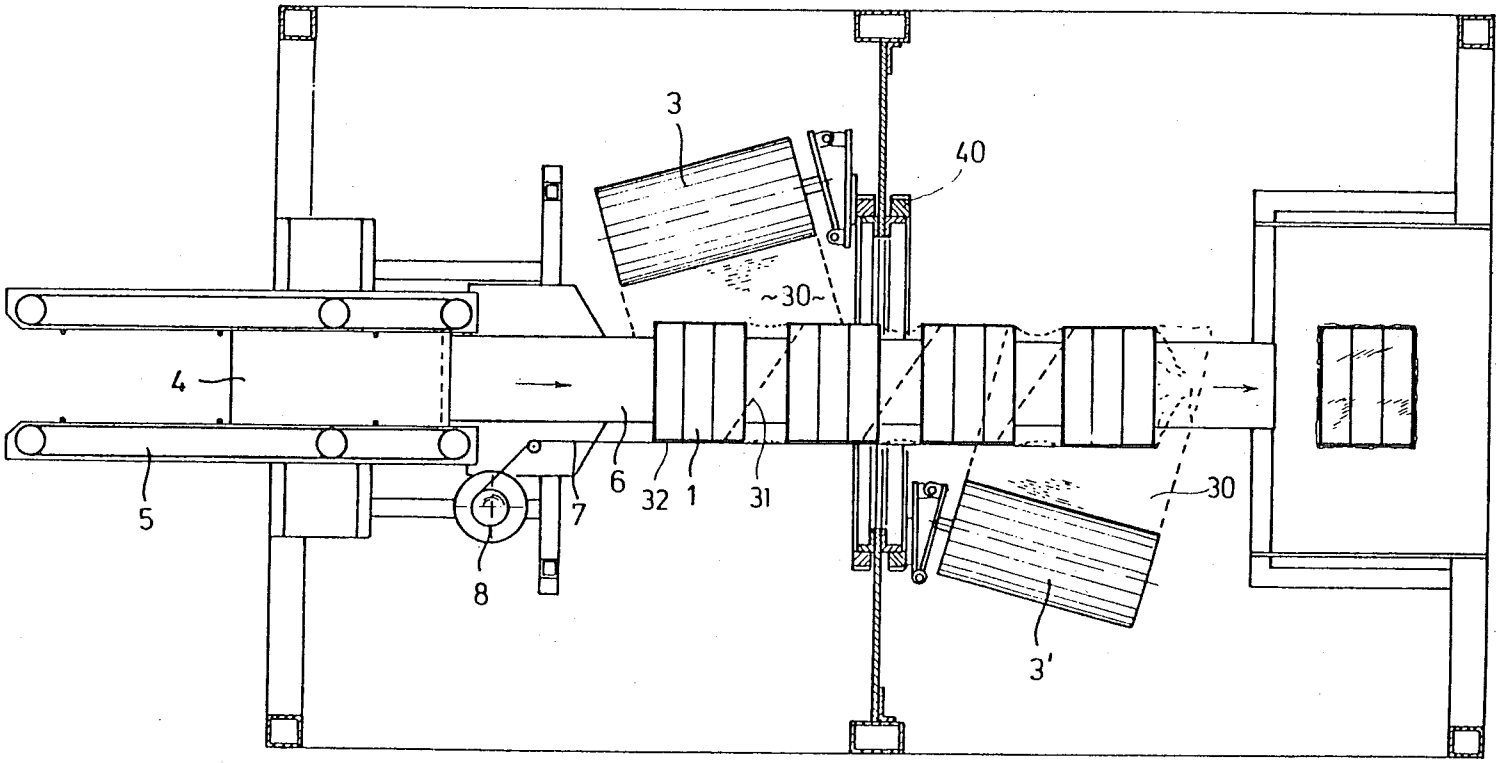
FIG. 1 is a plan view of a first embodiment of an apparatus for carrying out the method according to the present invention.

The method according to the present invention provides for the simultaneous wrapping of packages or packaged units in a film while the film wrapping (envelope) is provided with the tear-up thread which permits the wrapping about the wrapped packages or packaged units to be easily torn open at a subsequent time. Here the tear-up thread is drawn from a supply spool preferably continuously and smoothly, so as to come to be positioned on the desired side or upper side of the packages. The wrapping operation proper as performed by the wrapping device is not affected thereby. Depending on the size and type of the packages or packaged units, it is also possible to pass more than one tear-up thread to the packages.

At this point, it may be noted that it is known to continuously provide packaged units with a tear-up thread (compare U.S. Pat. No. 1,978,035). In the conventional method, however, the thread is not conjointly laid into a wrapping film hose, but rather incrementally sealed into an intitially open shrinking film to be closed subsequently. The enveloping of the thread takes place only when the film edges are joined together. Here, an adhesive thread substrate acts as holding means for the film edges.

Useful as tear-up threads are conventional colored (dyed), narrow and flexible film ribbons of, for example, polyvinyl chloride or polyesters. Other embodiments are possible as, on principle, any thread, strand or ribbon of textile material, metal or plastics material is useful which exhibits a sufficient tensile strength.

Useful as films are especially stretchable film webs of the kind according to the above-mentioned U.S. Pat. No. 4,317,322. However, less stretchable films may be used, too, such as of cellophane, polyvinyl chloride or various polyesters.

In order to still further facilitate tearing open of the film wrapping, preferably it is contemplated in this method that the film hose has incorporated therein a material weakening line extending along the length of the tear-up thread and adjacent thereto. Then, by applying tension to the tear-up thread, the film wrapping may be torn open along this line. As material weakening lines, there may be used a perforation or, alternatively, a non-perforating thermal thinnening (weakening of the material). The film hose is perforated or weakened correspondingly on either sides of the tear-up thread. Thus, there is formed a line or stripe underlaid by the tear-up thread. Weakening lines or perforations are formed in in the film in this method by conventional devices, such as heater wheels or spiked rollers.

On the other hand, it is also possible to employ, conformed specifically to the use of stretchable films, a tear-up thread having a surface structure contributing to tearing open or cutting of the film (web), such as, for example, a plastic wire having a cutting edge, teeth or spikes, or a film containing an admixture of hard mineral granules, such as glass chaff, which permit the film to be torn open even in the absence of a material weakening line.

When packages or packaged units are wrapped in film webs, which included a cardboard box package filled with a bulk material, it is essential that during the perforating step the film hose does not contact the packages or packets; otherwise, the risk of damage would arise. In such instance, perforation of the film may be effected conveniently on the outer or upper side of conveyor belts which enclose the packages or packets in the wrapping area of the wrapping device and which are wrapped in film in the course of the wrapping operation.

Seading of the tear-up thread to the packages can be performed most expediently when the tear-up thread or threads extends or extend linearly in the direction of travel or passage of the packages. On principle, however, it is also possible that the tear-up thread extends in the direction of travel in a zigzagged or wavy fashion.

The present invention provides for producing packages or packaged units including an easy-to-open film hose wrapping or envelope about the packages or packaged units wherein the easy-to-open film hose wrapping or envelope has at least one tear-up thread on the inner side of the wrapping or envelope which thread extends along the longitudinal direction of the hose. The thread adheres to the inner side of the film.

It is preferable when the tear-up thread is applied to the package or packaged unit from above. As the film wrapping hose constitutes a relatively flexible and also pressure-resilient structure, the provision of a material weakening line or breaking line involves difficulties. It is not readily possible to provide lateral spiked rollers or the like, because the pressure exerted by the rollers produces either too deep or almost ineffective perforations in the film.

In order to positively guide or lead the tear-up thread and to properly provide a weakening line (of rupture) in the web of the hose, the invention provides an apparatus for carrying out the method, which apparatus has provided below the film and above the package or packaged unit, a conveyor belt travelling at the speed of advance of the package or packaged unit. The tear-up thread is adapted to be applied to the package or packaged unit from above, and a stationary tongue is disposed at least in that area where the material weakening device presses against the film from above, with the tongue acting as an abutment surface for the latter device.

In addition to the supporting conveyor belt below the packages and packaged units, the apparatus for carrying out the method forther comprises a conveyor belt pressing against the packaged unit from above and preventing the packages or packaged units from being displaced laterally or tipping off the conveyor belt. It is found that the film being wrapped about both conveyor belts produces only a low pressing force in the central region of the upper conveyor belt portion, such that a tongue inserted in this position does not effect the further sliding movement of the film hose in the direction of conveyance or advance. Then, the spiked roller device positioned above the tongue and the applied film presses against the tongue at the right and left sides adjacent to the tear-up thread, thereby producing a precisely defined perforation in the film, and to thereby form a reproducible and adjustable line of weakened material.

However, the use of the above tongue provides a further surprising advantage. It has been found that the relatively long conveyor belts which contact the returning and driving pulleys in a completely free manner, may tend to become displaced to the right or left. Now, such displacement may be prevented from occuring when the tongue extends across the full length of the conveyor belt and, at the same time, acts as a belt-travel stabilizer. To this end, grooves or projections may be formed on the conveyor belt; a substantially more expedient facility is, however, to provide in the upper side of the belt a centrally extending groove of a depth to receive the tongue and thereby to prevent displacement of the belt to the right or left.

DETAILED DESCRIPTION OF EMBODIMENTS SHOWN IN THE FIGURES

The wrapping device shown in FIG. 1 comprises a winding or wrapping station 2 in which a pair of counterrotating supply rolls or reels 3 and 3' operate to helically, wrap a film (web) 30 about a plurality of packaged units 1 travelling in spaced apart relation, such that the packaged units 1 are enclosed in a film hose after having passed the wrapping station 2. The supply reels are mounted to a torus 40 which is shown in section in FIG. 1 and which is known per se.

Used as the film 30 is preferably a so-called stretchable film (web) which is drawn from the supply reels 3 and 3' under a tension.

The packaged units (or packets) 1 which comprise, for example a cubical combination of three cardboard boxes according to FIG. 1, are fed to the wrapping station 2 on a conveyor belt 4, with the units being additionally guided laterally by (further) conveyor belts 5. Prior to reaching the wrapping station 2, the units (packets) are transferred to bridging conveyor belts 6 which come into contact with the upper and lower sides of the units 1 to convey them through the wrapping station 2. In general, the units 1 travel linearly through the wrapping station 2 and the torus in the direction indicated by the arrow. The (upper) contacting bridging conveyor belt is not illustrated.

Immediately before the packaged units 1 reach the wrapping front 31 of the film 30, a tear-up thread 7 drawn from a supply spool 8 is passed laterally toward the unit 1 which is the reat to pass the wrapping front 31.

For example, a narrow (ribbon of) film of polyvinyl chloride having a tear strength greater than that of film 30 is used as tear-up thread 7. One side of thread 7 is provided with an adhesive layer. Thus, when thread 7 passes wrapping front 31, thread 7 is pressed by film 30 to one of the side faces of the packaged unit 1 which projects laterally from the bridging conveyor belts 6. The adhesive layer on thread 7 then adheres to the inner side of the film 30.

During its passage through the wrapping station 2, the tear-up thread 7 is continuously unreeled from the supply spool 8, to come into contact with the side faces 32 of the subsequent packaged units 1. Instead of a single tear-up thread 7, it is also possible to apply a plurality of tear-up threads to the packaged units 1, not only at the sides, but also at the upper or lower side of each unit.

Upon its travel through the wrapping station 2, the film hose is perforated by a needle roller or spiked roller 20 (shown in FIG. 4) on either sides of the tear-up thread 7.

At the end of the path of conveyance, the film hose is released by the bridging conveyor belts 6, whereupon the hose tightly contacts the packaged unit under the pretension of the film 30. By means of a cutting device 34 (shown in FIG. 3), the hose is thereafter severed along with the tear-up thread 7 at the rear of each discharge packaged unit 1.

It may be noted that the method according to the invention can be performed not only by the illustrated apparatus, but rather by any wrapping systems in which a film hose is produced in the course of the wrapping operation.

Figure 2:
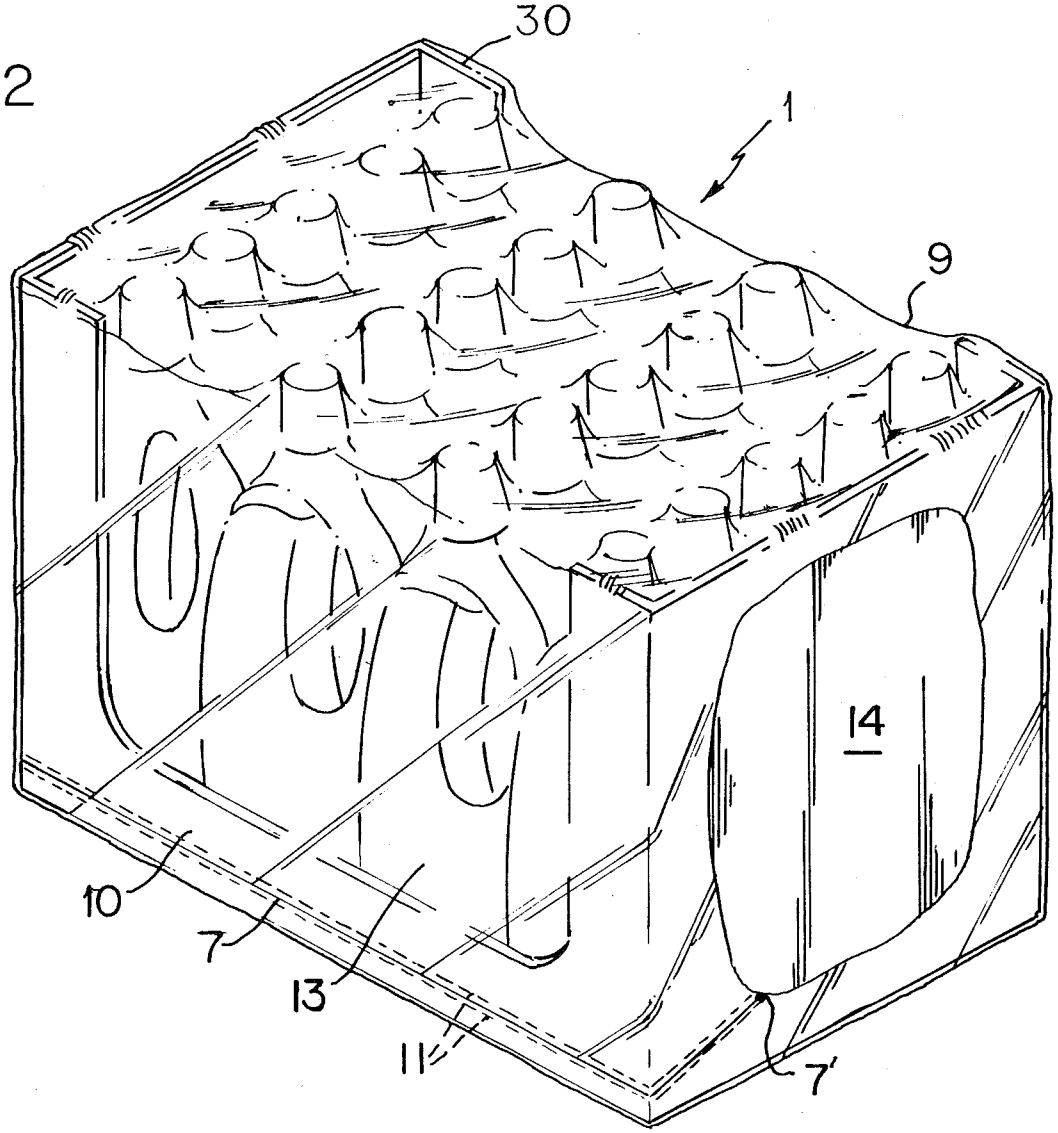
FIG. 2 is a perspective view of packaged unit produced by the method of the present invention and includes a film hose wrapping.

FIG. 2 illustrates a final packaged unit 1 provided with a film hose wrapping (or envelope) 9 and containing bottles 13. The film hose wrapping 9 acts to tightly hold together the plastic bottles contained in the packaged unit. The packaged unit comprises the bottles and a carrying cardboard box being open at the sides and at its top, so as to prevent displacement of the bottles. In the wrapping operation, the front faces 114 of the package, facing in the direction of travel of the wrapping operation, define points where the film hose was severed. The front faces 14 of the package have only their edge regions covered by the film.

The film hose wrapping 9 holds on the inner side and at the level of a narrow edge strip 10 at the lower edge of a side face 32 of the cardboard package, the tear-up thread 7 which is adhered to the inner side of the film 30. The tear-up thread 7 extends in parallel with the edge or marginal strip 10 towards the ends of the film hose section. Extending along both sides of the tear-up thread 7 are lines of perforations 11 along which the film hose wrapping 9 may be easily torn open by applying a tension to the thread end 7'. In order to clearly indentify the tear-up position of the packaged unit, the tear-up thread is colored.

Figure 3:
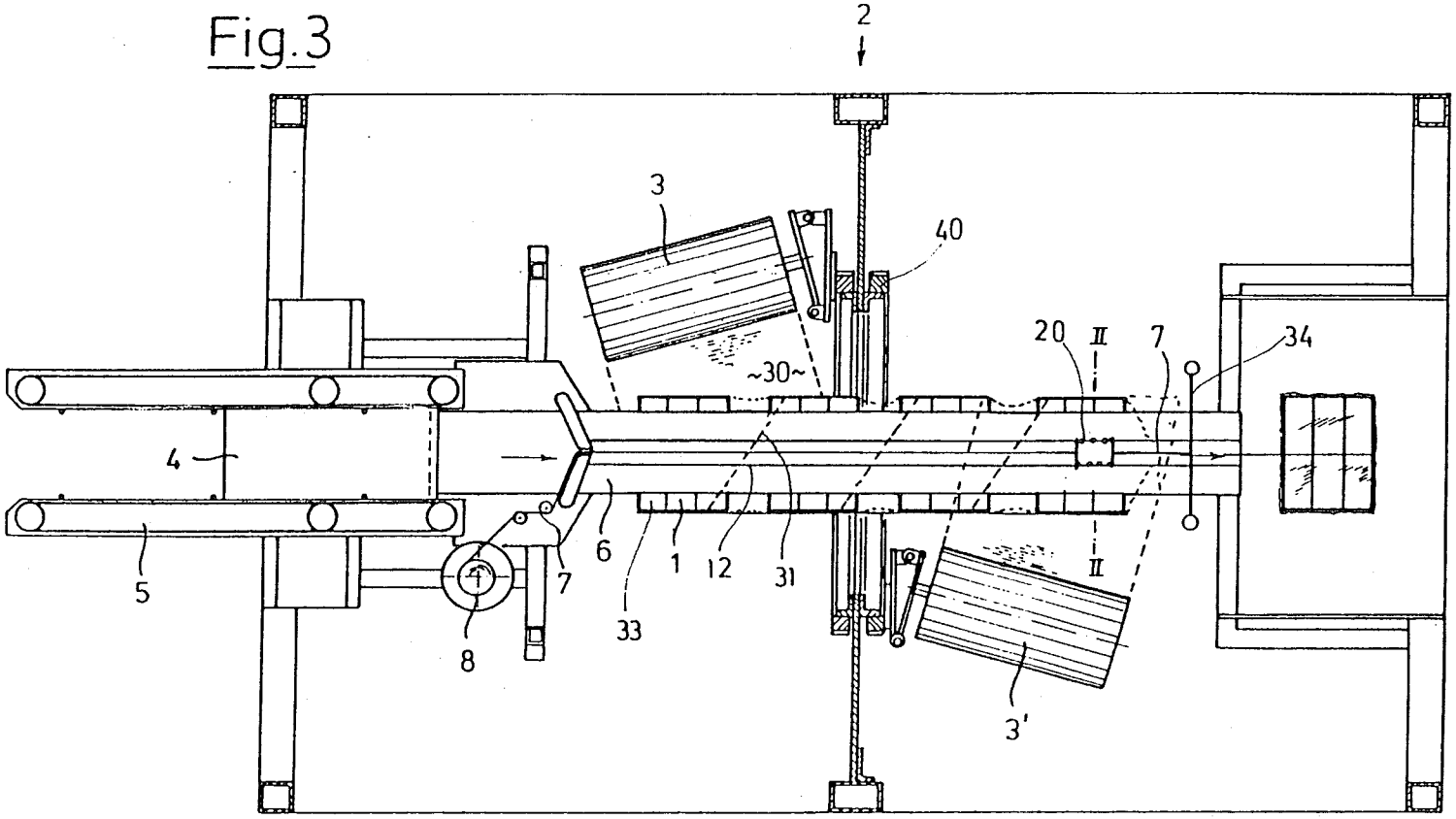
FIG. 3 is a plan view of a second embodiment for carrying out the method of the present invention.

The wrapping device shown in FIG. 3, similarly as the one according to FIG. 1, comprises a wrapping station 2 in which the packaged unit 1, upon having passed through the wrapping station 2, is wrapped in a film hose by a pair of counter-rotating supply reels 3 and 3' operative to wrap the film 30 about the packaged unit 1. Used as the film 30, is preferably a so-called stretchable film which is drawn (unreeled) from the supply reels 3 and 3' under tension.

Figure 4:
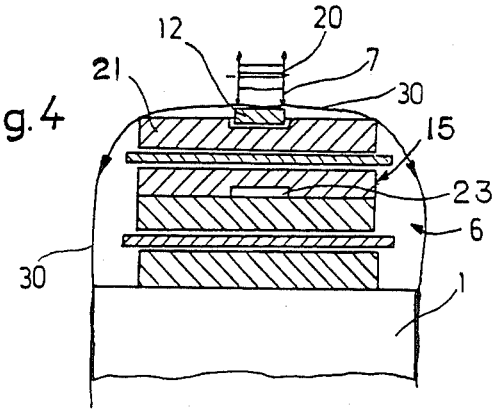
FIG. 4 is a sectional view along sectional lines II—II in FIG. 3, showing in section only the conveyor contacting belt device.

The packaged units 1 to be wrapped are fed to the wrapping station 2 on a conveyor belt 4, with these units being additionally guided or conveyed at their sides by further conveyor belts 5. Prior to reaching the wrapping station 2, the packaged units 1 are transferred to received by bridging conveyor belts 6 with one of them contacting the upper sides 33 of the units 1 to convey them through the wrapping station. The bridging conveyor belts are so-called dual or twin conveyor belts (compare U.S. Pat. No. 4,317,322). FIG. 4 shows in sectional view a dual or twin conveyor belt of this type.

Immediately before the packaged units 1 reach the wrapping front 31 of the film 30, a tear-up thread 7 unreeled from a supply spool 8 is passed from above to the packaged unit 1 being the next one to pass through the wrapping front 31.

Upon its passage through the wrapping station 2, the film hose is perforated on either sides of the tear-up thread 7 by a needle roller or spiked roller 20. The perforating step is performed on the upper section 21 of the upper bridging conveyor belt 6 which is enveloped by the film 30 along with the packaged units. Thus, damage to the packaged unit proper by the perforating device is positively prevented (compare FIG. 4).

Above the upper section 2 travelling at the speed of conveyance of the packaged units 1, there is provided a stationary, elongated tongue 12 against which the spiked roller 20 pressed from above; in other words, the tongue 12 serves as an abutment surface for the material weakening device (spiked roller 20).

The upper one (15) of the two dual or twin conveyor belts is additionally provided with a centrally formed groove 23 in its upper side, into which groove the tongue 12 extends to be guided thereby with so tight a fit that the tongue 12 constitutes a belt stabilizing device for the belt 15. The film 30, extending across the belt and the tongue, slides along the stationary tongue 12 without being subjected to damage, as substantially no vertical force is exerted by the film in the central region of the belt.

Figure 5:
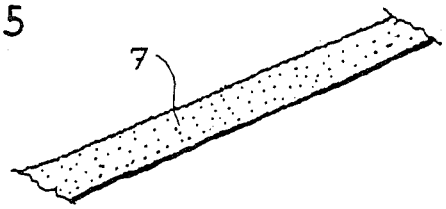
FIG. 5 shows a specific embodiment of a tear-up thread.

FIG. 5 illustrates a tear-up thread specifically useful for stretchable films, which thread has a surface structure facilitating the severing of the film. The tear-up thread 7 is formed of polyvinyl choride having dispersed therein metal granules 17 which protrude slightly above the film particularly at the edge thereof, so as to facilitate (initial) tearing of the film proper.

I claim:

1. An apparatus for wrapping a package, comprising:

a wrapping device through which said package can be conveyed;

upper and lower transport means for conveying a package towards and through said wrapping device;

means for providing a tear-up thread having first and second sides, and applying the first side of said tear-up thread to a said package as said package is being conveyed through said wrapping device, said second side of said tear-up thread having an adhesive coating;

means for providing a film hose and wrapping said film hose about said package and said upper transport means as said package passes through said wrapping device, said film hose being formed by helically wrapping a stretch wrap film hose enclosing foil about said package, said film hose enclosing said tear-up thread along the length of a said package, said second side of said tear-up thread contacting said film hose and being adhesively bound thereto; and means for severing said thread after said package passes through said wrapping device and means for forming a material weakening line in the film hose wrapped around a package upon the passage of the wrapped package through said wrapping device, said material weakening line extending substantially the length of said tear-up thread, said film hose being maintained by said upper transport means at a spaced distance from said package while said material weakening line is being formed in said film hose.

2. An apparatus according to claim 1 wherein said upper and lower transport means comprise upper and lower conveyor belts.

3. An apparatus according to claim 2 wherein said upper conveyor belt further comprises a tongue extending along the full length of an upper side of said upper conveyor belt.

4. An apparatus according to claim 2, wherein said upper conveyor belt has a longitudinal groove located on an outward surface thereof and a tongue which extends within said groove of said belt.

5. An apparatus according to claim 4 wherein said weakening line forming means further comprises a spike roller which rolls against said film hose as said film hose passes over said tongue.

6. An apparatus according to claim 5 wherein said groove is formed centrally in said belt.

* * * * *